US006554151B1

(12) United States Patent
Brennan

(10) Patent No.: US 6,554,151 B1
(45) Date of Patent: Apr. 29, 2003

(54) WASTE RECEPTACLE WITH AIR FRESHENER

(76) Inventor: James Brennan, 309 Hemlock St., Vacaville, CA (US) 95688

( * ) Notice: Subject to any disclaimer, the term of this patent is extended or adjusted under 35 U.S.C. 154(b) by 0 days.

(21) Appl. No.: 09/995,317

(22) Filed: Nov. 27, 2001

(51) Int. Cl.[7] ..... B65D 25/16
(52) U.S. Cl. ..... 220/495.04; 220/908.2
(58) Field of Search ..... 206/5; 220/495.04, 220/908.2; 239/40

(56) References Cited

U.S. PATENT DOCUMENTS

| | | | | |
|---|---|---|---|---|
| 1,157,008 A | * | 10/1915 | Lang | 100/218 |
| 1,286,368 A | | 12/1918 | Lucas | |
| 1,911,724 A | | 5/1933 | Stein | |
| 4,427,110 A | * | 1/1984 | Shaw, Jr. | 206/205 |
| 5,163,579 A | | 11/1992 | Jones | |
| 5,388,717 A | * | 2/1995 | LeVasseur | 220/495.06 |
| 5,690,247 A | | 11/1997 | Boover | |
| 5,725,645 A | * | 3/1998 | Wickland et al. | 206/524.8 |
| D398,122 S | | 9/1998 | Presock et al. | |
| 5,803,303 A | * | 9/1998 | Timm et al. | 220/495.04 |
| 6,000,571 A | * | 12/1999 | Brooks et al. | 220/495.04 |
| D418,958 S | | 1/2000 | Wood et al. | |

* cited by examiner

*Primary Examiner*—Joseph M. Moy
(74) *Attorney, Agent, or Firm*—Thomas R. Lampe

(57) ABSTRACT

A waste receptacle is combined with an air freshener connected to the waste receptacle. Removal of a trash bag from the waste receptacle will cause a flow of air through the opening and air freshener to freshen the interior of the waste receptacle.

5 Claims, 2 Drawing Sheets

WASTE RECEPTACLE WITH AIR FRESHENER

TECHNICAL FIELD

This invention relates to a waste receptacle for holding trash, garbage and the like.

BACKGROUND OF THE INVENTION

Waste receptacles are widely used in homes, businesses and other locations. Many of these receptacles are employed with flexible inner liner bags which prevent the garbage, trash or other waste from contacting the receptacle per se. These bag liners are removed and disposed of along with the trash contained therein on a periodic basis.

To facilitate removal of the flexible liner bag from a trash receptacle, it is known to provide elements on the receptacle which are engaged by the user's foot to prevent upward movement of the receptacle when the bag is being removed therefrom. Examples of such arrangements are shown in the following United States Patents: U.S. Pat. No. 5,163,579, issued Nov. 17, 1992, U.S. Pat. No. 1,911,724, issued May 30, 1933, U.S. Pat. No. DES 398,122, issued Sep. 8, 1998, U.S. Pat. No. DES 418,958, issued Jan. 11, 2000, U.S. Pat. No. 5,690,247, issued Nov. 25, 1997, and U.S. Pat. No. 1,286,368, issued Dec. 3, 1918. The UTS trash receptacle made available by SacSaver, Reno, Nev. incorporates two indented portions located at opposed sides of the receptacle and extending inwardly from the bottom thereof which accommodate the user's feet so that the feet engage lower walls of the indented portions to prevent upward movement of the trash container when a liner bag is removed.

DISCLOSURE OF INVENTION

The present invention, in common with the arrangements disclosed in the above-identified prior art, includes a foot 10 engaging element which is utilized to hold a waste receptacle in place during removal of a liner bag. However, the present invention differs from the known prior art in that it incorporates an air freshener which cooperates with the receptacle and the bag to introduce freshened air into the waste receptacle interior responsive to upward movement of the bag during removal thereof.

More particularly, the waste receptacle of the present invention has a top, a bottom and at least one side wall defining a waste receptacle interior and an opening below the top leading from the waste receptacle interior to the ambient atmosphere. The opening allows for the ingress of air into the waste receptacle interior.

The invention also includes an air freshener operatively associated with the waste receptacle and located where the air freshener is impacted by air flowing into the waste receptacle interior through the opening to freshen the air.

A flexible trash bag is located within the waste receptacle interior in engagement with the bottom and the at least one side wall. The flexible trash bag and the waste receptacle are cooperable upon upward movement of the flexible trash bag relative to the waste receptacle away from the bottom to create a partial vacuum between the bottom and the flexible trash bag within the waste receptacle interior causing air flow from the ambient atmosphere through the opening and into the waste receptacle interior. The flowing air is "freshened" by the air freshener.

Other features, advantages and objects of the present invention will become apparent with reference to the following description and accompanying drawings.

MODES FOR CARRYING OUT THE INVENTION

Figure 1:
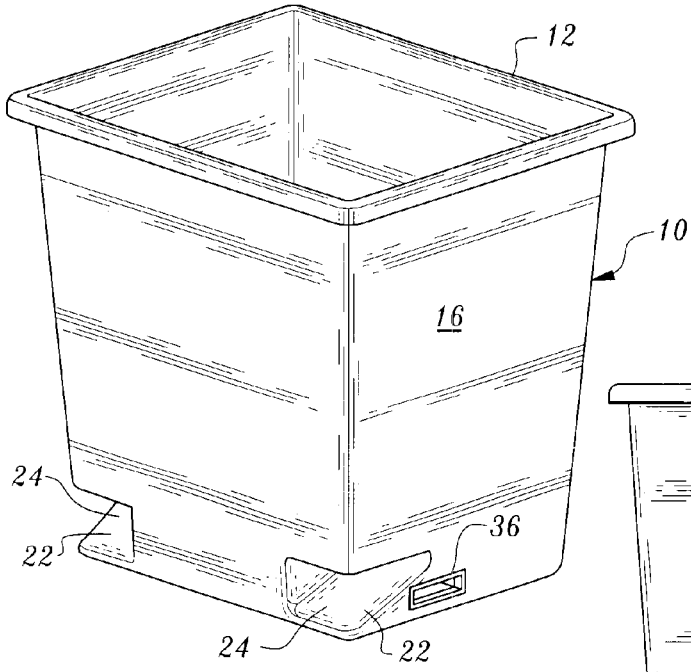
FIG. 1 is a perspective view of a waste receptacle constructed in accordance with the teachings of the present invention having an air freshener connected thereto.
Figure 2:
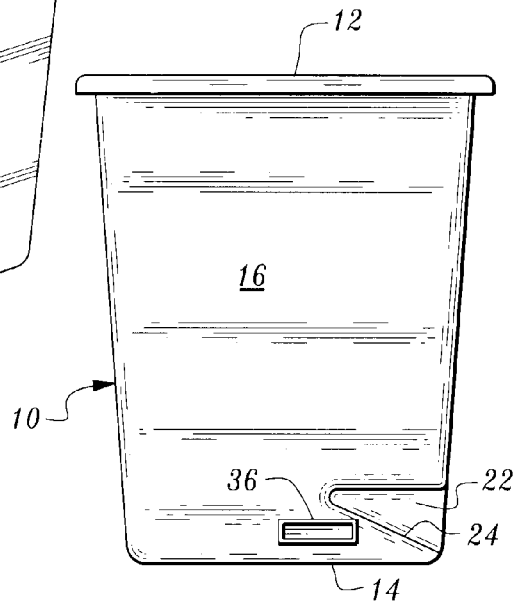
FIG. 2 is a side elevational of the receptacle and air freshener.
Figure 3:
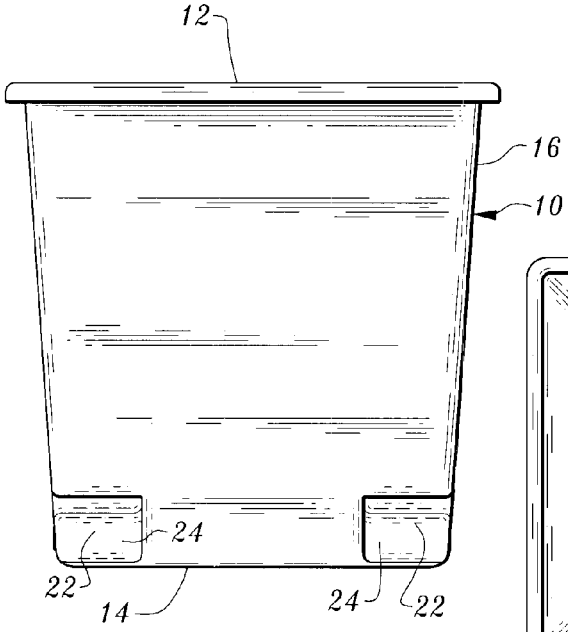
FIG. 3 is a front, elevational view of the receptacle.
Figure 4:
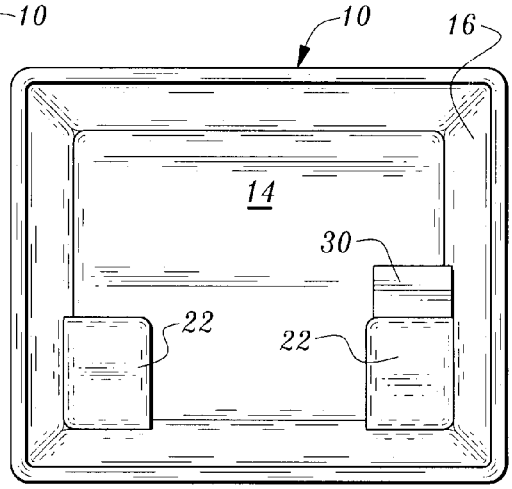
FIG. 4 is a top, plan view of the receptacle.
Figure 5:
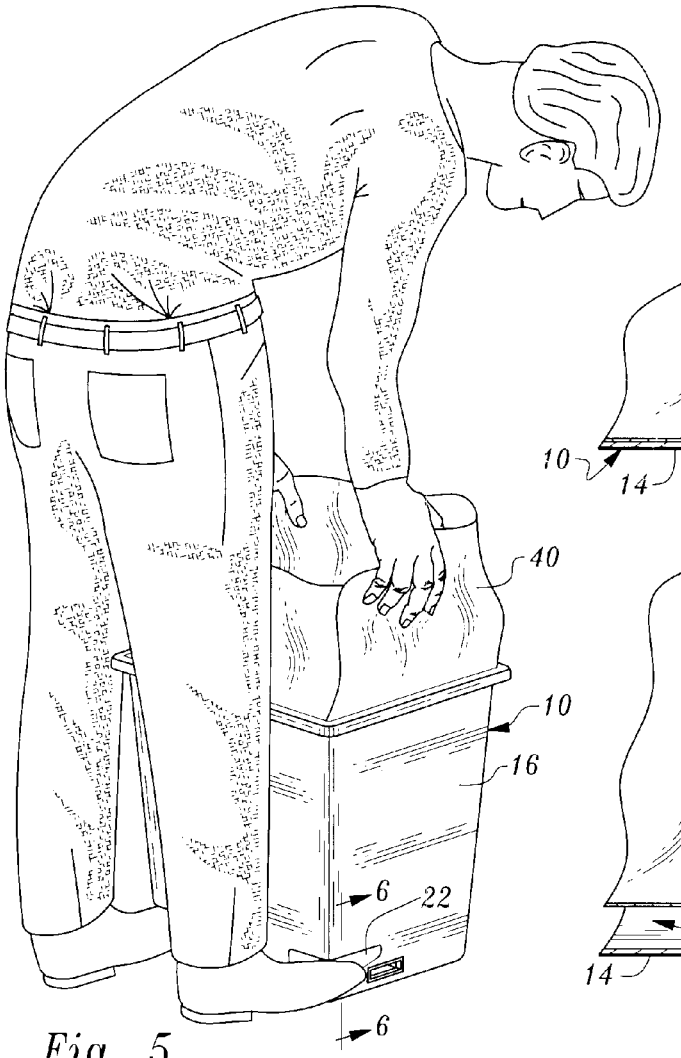
FIG. 5 is a perspective view illustrating an individual with his feet engaging the waste receptacle and in the process of removing a flexible liner bag therefrom.

Referring now to FIGS. 1–8, a preferred embodiment of, the invention is illustrated.

A waste receptacle 10, suitably formed of molded plastic, includes an open top 12, a bottom 14 and four interconnected side walls including side wall 16. An opening 20 is defined by side wall 16 and the opening is in communication with the waste receptacle interior. The opening 20 allows for the ingress of air into the waste receptacle interior from the ambient atmosphere.

The waste receptacle 10 includes recess defining means in the form of pockets or indents 22 which project inwardly as shown. Each pocket includes a foot engagement element in the form of an inclined wall 24 projecting upwardly from the bottom 14. Each inclined wall 24 and the bottom defines a space therebetween partially comprising the waste receptacle interior. Opening 20 adjoins the space between the inclined wall 24 associated with side wall 16 and directly communicates therewith.

An air freshener 30 is connected to the waste receptacle 10 and located at opening 20. More particularly, air freshener 30 is in the form of a container 32 accommodating air freshener material of any suitable known type disposed within the container. The term "air freshener material" as used herein is employed in its broadest sense and encompasses any material which deodorizes or sanitizes air in contact therewith, whether scented or unscented. Air freshener structures are well known per se and the invention can be practiced using a wide variety thereof. For purposes of illustration, the container 32 incorporates an inner foraminous compartment 34 confining the air freshener material, which may be granular or solid. The foraminous container compartment 34 allows for the free flow of air through the container as shown, for example, in FIG. 7.

Figure 6:
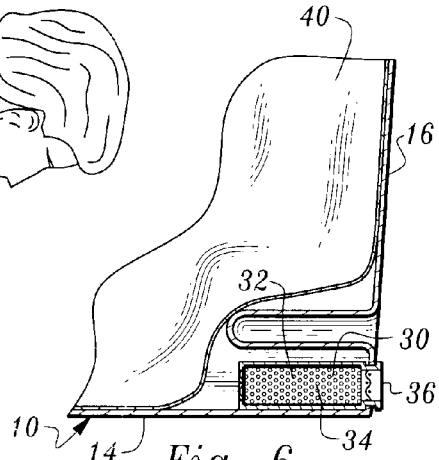
FIG. 6 is an enlarged, cross-sectional view taken along the line 6—6 in FIG. 5.
Figure 7:
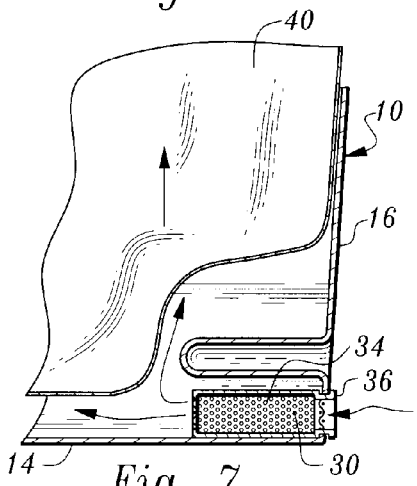
FIG. 7 is a view similar to FIG. 6, but illustrating the liner bag being removed from the receptacle and arrows schematically illustrating air flow created by bag removal.
Figure 8:
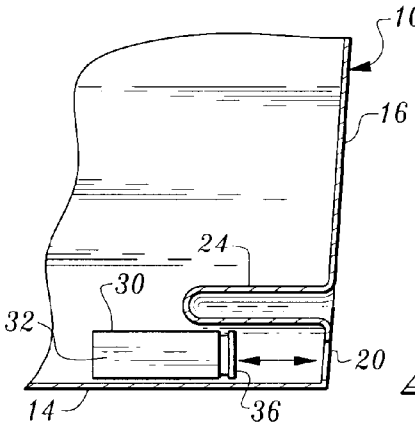
FIG. 8 is a cross-sectional view of a portion of the receptacle and showing installation of an air freshener container.

FIG. 8 shows the container 32 being releasably connected to the waste receptacle 10. This is accomplished by manually placing an end of the container into engagement with side wall 16 below inclined wall 24 and applying an endwise force on the container to cause a lip 36 on the container to deform and snap the lip into place on the portion of the wall 16 defining opening 20. When the container 30 is installed in place as shown in FIGS. 6 and 7, for example, the portion of the waste receptacle defining the opening 20 is positioned in an indent between the lip 36 and the rest of the container. Removal of the container can be accomplished by pulling the container so that the lip 36 deforms and allows passage thereof back through opening 20. It is to be noted that the container 30 has a cross-section of rectangular-shape, corresponding to the shape of opening 30. This is merely representative of the many shapes of the opening and container which can be utilized.

When the container 30 is in position in the waste receptacle, it is partially disposed under the inclined wall 24 and located in the space between that inclined wall and the bottom of the trash receptacle. This affords protection for the container, minimizing contact with a flexible trash bag and trash within the receptacle. In the arrangement illustrated, only one opening 20 and air freshener 30 are provided. It will be appreciated, however, that an air freshener could be disposed under the other foot receiving pocket 22 of the receptacle, if desired.

In FIG. 6, a flexible trash bag 40 of any conventional type is shown in place in the receptacle 10, the bag engaging the bottom 14 and side walls of the receptacle in a conventional way. Of course, the introduction of trash, garbage or other waste into the bag will cause such contact to be rather tight.

FIG. 7 shows the bag 40 being moved upwardly in the direction of the vertical arrow away from the bottom 14. This movement causes the flexible trash bag and the waste receptacle to create a partial vacuum between the bottom and the bag within the waste receptacle interior, causing air flow from the ambient atmosphere through the opening 20, through the air freshener 30 and into the waste receptacle interior below the bag.

Figure 9:
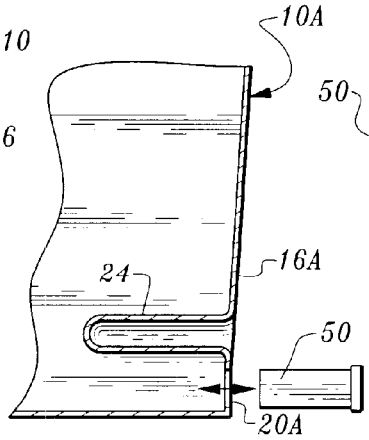
FIG. 9 is a view similar to FIG. 8, but illustrating an alternative form of air freshener.
Figure 10:
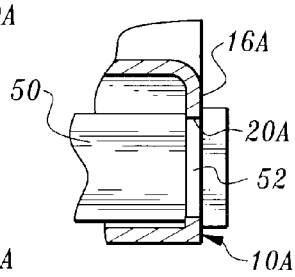
FIG. 10 is an enlarged view illustrating a portion of the receptacle of FIG. 9 in cross-section and showing a segment of the alternative form of air freshener in place on the receptacle.

FIGS. 9 and 10 illustrate another form of the invention wherein a receptacle 10A has a circular opening 20A formed in a side wall 16A thereof.

The container of the air freshener 50 also has circular cross-sectional configuration and in this instance is put into place from a location external of the waste receptacle. A circular-shaped intent 52 of the container releasably retains therein the portion of wall 16A forming opening 20A to maintain the air freshener in place until removal thereof is desired.

The invention claimed is:

1. In combination:

a waste receptacle having a top, a bottom and at least one side wall, said waste receptacle defining a waste receptacle interior for holding a trash bag and an opening below said top leading from said waste receptacle interior to the ambient atmosphere, said opening allowing for the ingress of air into said waste receptacle interior; and an air freshener operatively associated with said waste receptacle and positioned at a location in which said air freshener is impacted by air flowing into the waste receptacle interior through said opening to freshen the air, said waste receptacle including recess defining means defining a recess for receiving an individual's foot, said recess defining means including a foot engagement element projecting inwardly from said at least one side wall and located above said bottom to define a space between the bottom and foot engagement element partially comprising said waste receptacle interior, said opening adjoining said space and directly communicating therewith, said air freshener comprising a container accommodating air freshener material, said combination additionally comprising connector means releasably connecting the container to said waste receptacle, said container being in said space and located under said foot engagement element to protect the container and minimize contact between the container and the trash bag.

2. The combination according to claim 1 wherein said connector means is attached to said container and defines an indent receiving a portion of said waste receptacle defining said opening.

3. The combination according to claim 1 wherein said foot engagement element is an inclined wall projecting upwardly from said bottom.

4. The combination according to claim 1 additionally comprising a flexible trash bag located within said waste receptacle interior in engagement with said bottom and said at least one side wall, said flexible trash bag and said waste receptacle cooperable upon upward movement of said flexible trash bag relative to said waste receptacle away from said bottom to create a partial vacuum between the bottom and the flexible trash bag within said waste receptacle interior causing air flow impacting the air freshener from said ambient atmosphere through said opening and into said waste receptacle interior.

5. The combination according to claim 1 wherein said waste receptacle has a plurality of side walls, said opening being defined by one of said side walls and said foot engagement element projecting inwardly from another of said side walls.

* * * * *